United States Patent [19]

Villa-Real

[11] 4,389,755

[45] Jun. 28, 1983

[54] MULTI-PURPOSE PAPER-WORK ORGANIZER CLIP INTEGRATED WITH ATTACHABLE DETACHABLE INFORMATIVE INDICIA

[76] Inventor: Antony-Euclid C. Villa-Real, 2512 Capistrano Ave., Las Vegas, Nev. 89121

[21] Appl. No.: 233,913

[22] Filed: Feb. 12, 1981

[51] Int. Cl.[3] ..... B42F 1/06; G09F 3/02

[52] U.S. Cl. ..... 24/67.9; 40/11 R; 40/23 A

[58] Field of Search ..... 24/343, 67.9, 67.11, 24/DIG. 8, DIG. 9; 40/11 R, 23 R, 23 A

[56] References Cited

U.S. PATENT DOCUMENTS

| | | | |
|---|---|---|---|
| 285,435 | 9/1883 | Schlechter | 24/DIG. 9 |
| 898,651 | 9/1908 | Hoisington | 40/23 R |
| 1,055,397 | 3/1913 | Herold | 40/23 A |
| 2,363,418 | 11/1944 | Hosmer | 40/11 R |
| 2,478,376 | 8/1949 | De Swart | 24/67.9 |
| 2,802,250 | 8/1957 | Klotz | 24/343 |
| 2,938,252 | 5/1960 | Scheemaeker | 40/23 A |
| 3,123,924 | 3/1964 | Roberts | 40/23 A |
| 3,131,445 | 5/1964 | Lorber | 24/67.9 |
| 3,225,469 | 12/1965 | Chase | 24/67.9 |
| 3,290,810 | 12/1966 | Morena | 40/23 A |
| 3,354,564 | 11/1967 | Falcone et al. | 40/11 R |
| 3,583,358 | 6/1971 | Hanson, Jr. | 40/23 A |
| 4,286,358 | 9/1981 | Levin | 40/23 A |

FOREIGN PATENT DOCUMENTS

| | | | |
|---|---|---|---|
| 203466 | 11/1958 | Austria | 24/67.9 |
| 568514 | 6/1958 | Belgium | 24/67.9 |
| 759538 | 2/1934 | France | 40/23 A |
| 1183595 | 7/1959 | France | 24/67.9 |
| 1489764 | 7/1967 | France | 24/67.9 |
| 9930 | of 1911 | United Kingdom | 40/11 R |

*Primary Examiner*—Paul J. Hirsch

*Attorney, Agent, or Firm*—Sughrue, Mion, Zinn, Macpeak & Seas

[57] ABSTRACT

An improved paper clip is disclosed for clipping a plurality of paper work wherein the front face portion of the clip has a laterally extending area to accommodate informational or instructional indicia which can be changed or updated according to the organizational needs of the user. An integrally formed hook structure is also provided in one embodiment to permit hanging the clips and paper work on a supporting structure.

11 Claims, 13 Drawing Figures

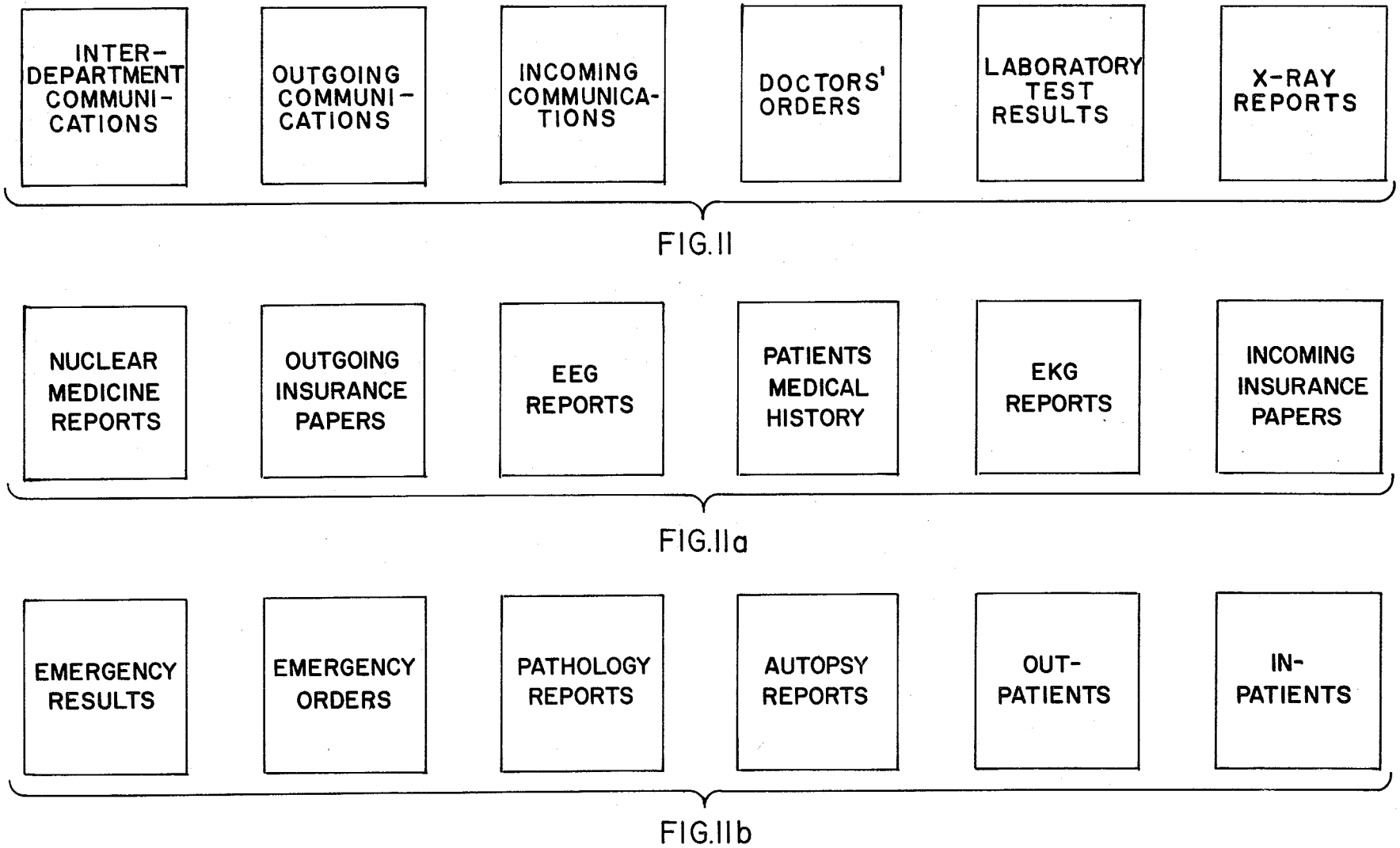
INTER-DEPARTMENT COMMUNI-CATIONS
OUTGOING COMMUNI-CATIONS
INCOMING COMMUNICA-TIONS
DOCTORS' ORDERS
LABORATORY TEST RESULTS
X-RAY REPORTS
FIG.11
NUCLEAR MEDICINE REPORTS
OUTGOING INSURANCE PAPERS
EEG REPORTS
PATIENTS MEDICAL HISTORY
EKG REPORTS
INCOMING INSURANCE PAPERS
FIG.11a
EMERGENCY RESULTS
EMERGENCY ORDERS
PATHOLOGY REPORTS
AUTOPSY REPORTS
OUT-PATIENTS
IN-PATIENTS
FIG.11b

MULTI-PURPOSE PAPER-WORK ORGANIZER CLIP INTEGRATED WITH ATTACHABLE DETACHABLE INFORMATIVE INDICIA

BACKGROUND OF THE INVENTION

It is a well known fact that in most offices, homes and hospitals there are usually mountains of disorganized paper work lying, not only on the table, on the floor, but in various other unexpected places, causing nerve-wracking problems of disorganization and distraction to the people involved, thereby causing unnecessary tension in our society. This happens because in the midst of coping with the volumes of incoming and outgoing paper work, there are so many interruptions because of appointments, telephone calls, and other unexpected events which interfere with the flow of work.

This is also true among students in universities and colleges on a worldwide basis.

Various types of paper clips have been developed in an attempt to alleviate disorganized paper work. For example, efforts have been made to provide paper clips which have a very secure grip on the sheets to which it is applied, so that the sheets cannot become unfastened and the clip will not work loose or out of place. Among such efforts are those described in the U.S. Pat. Nos. 1,878,861 to Krasnow; 1,700,977 to Butler; 1,622,682 to Sponsel and 1,823,564 to Hutchings. However, none of prior art disclose paper clips which not only provide secureness for a plurality of papers but also include detachable instructional information to allow for or to permit the changing or updating of information in order to effect better segregation of various groups of paper work for any desired purpose.

SUMMARY OF THE INVENTION

The present invention provides a basic but special type of paper clip having a front face portion with a laterally extending area that is adequately large enough to provide an area for adhesively attaching a self-sticking gummed paper with certain brief instructional information thereby providing the user with specific on-the-spot visual indication and recognition of what to do with a plurality of related paper work.

Another object of the invention is to provide a simple structural embodiment with effective functional use, by having a specially designed paper clip having a laterally extending area that can accommodate a properly dimensioned label containing information indicia which may be pre-printed or handwritten or typed as required.

And yet another object of the invention is to provide not only color codings for each kind of widely acceptable instructional information depending upon the department of kind of work done, but also color codings for the specific type of paper clips.

And still another object of the invention is to better organize groups of paper work in order to enable the user or users to work faster and with greater efficiency, while solving the emotional stree related to the volumes of incoming and outgoing paper work.

Still a further object of the invention is to provide a simple device which can prevent the unnecessary disorganizational problems among secretaries, students, teachers, nurses, doctors, and other professional as well as the lay public in tackling the loads of paper work that come in various sizes and at various intervals.

And still another object of the invention is to provide a systematic visual and mental programming of the user to facilitate the flow of paper work by lowering the negative visual feedback creating confusion that predisposes the individual to unnecessary headaches and emotional tension.

A further object of the invention is to provide a paper clip that will not only provide a clipping capability for segregating groups of related plurality of paper work, but also provides hanger means for attachment to walls or other places for filing or visual observation.

BRIEF DESCRIPTION OF THE DRAWINGS

FIGS. 8, 9, 10, 11, 11*a*, 11*b* show various shaped and informational data that may be affixed to the laterally extending indicia receiving area of the paper clip of the present invention.

DETAILED DESCRIPTION OF THE DRAWINGS

Figure 1:
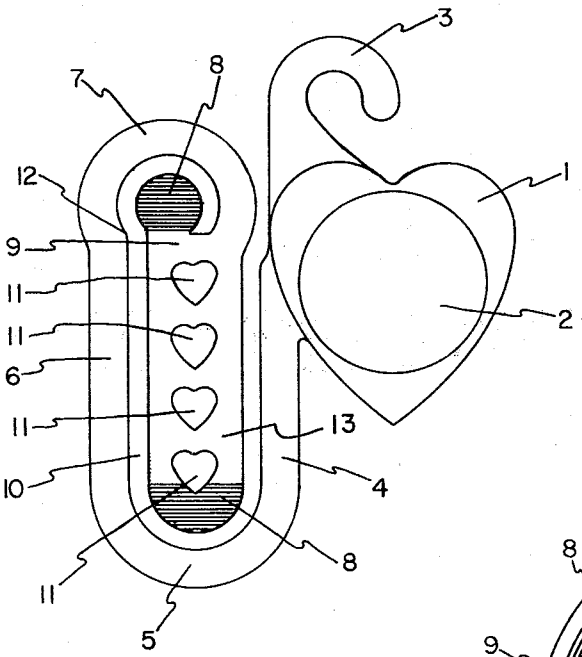
FIG. 1 is a front elevational view of the paper clip of the present invention with integrally formed hook member and laterally extending portion adapted to receive indicia thereon.

Referring now to the drawings wherein like reference numerals and numeral-letter combination refer to like structure. There is shown at FIG. 1 the paper clip of the present invention including a flat flag-like lateral extension 1 having a heart shaped configuration. An area 2 is provided on the lateral extension for accommodating adhesive-backed informational indicia which will hereinafter be described. A hook-like member 3 extends from the top of the lateral extension 2 and is formed integral therewith for attaching and hanging the clip to a wall, bulletin board or other support for filing or visual observation.

The flag-like extension 1 is attached to the clip portion through a right connection arm 4, a lower arcuate member 5, a left connection arm 6 and an upper arcuate hinge member 7. The upper arcuate hinge member 7 is in turn connected to the central member 13 at the area 9. These various elements are all formed as a one-piece integral unit from any suitable plastic material and together comprise an outer hinge portion. At the upper and lower ends of the central member 13 is provided a frontal ridged surface 8 in the form of parallel ribs which aid in preventing slippage of the clip from the paperwork engaged against the backside of the clipped paperwork.

A space or slot 10 extends between the central member 13 and the connecting structure. Within this slot 10 the papers to be clipped are placed and held. The central member 13 is merely flexed backward, and the papers placed between it and the connecting structure, thereby resiliently engaging and holding the papers placed therein. A protuberance 12 is further provided to aid in gripping and preventing slippage of the paperwork. The connecting member 13 further includes a plurality of spaced holes 11 which may be of any desired shape and which reduce the amount of plastic material required to form the clip.

Figure 2:
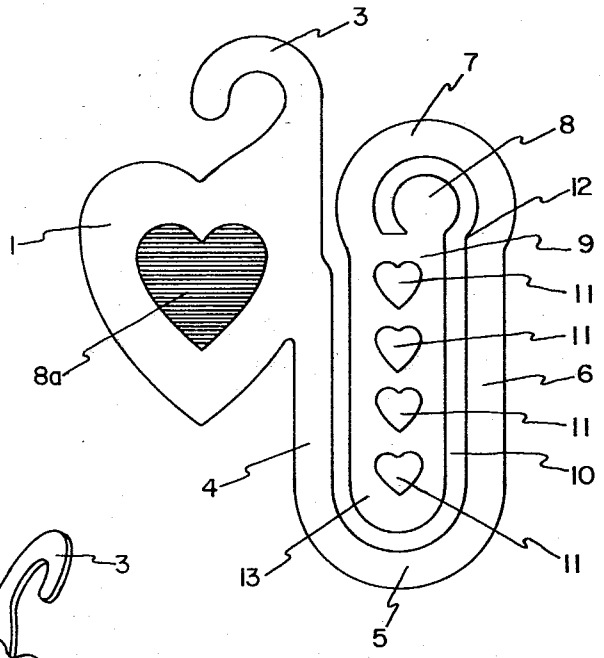
FIG. 2 is a back elevational view of the paper clip shown in FIG. 1.

At FIG. 2 is shown the back view of the clip described in FIG. 1 and also showing at 8*a* the backside ridged surface which engages against the front surface of the clipped paperwork to aid in preventing slippage.

Figure 3:
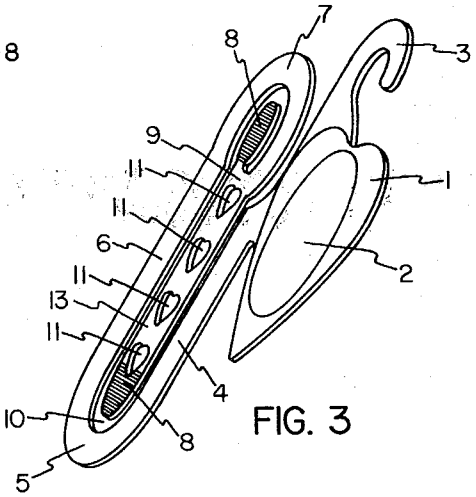
FIG. 3 is a perspective view of the paper clip of the present invention.

At FIG. 3 is shown a perspective view of the clip of the present invention showing the uniform thickness of the clip and its flat planar construction.

Figure 5:
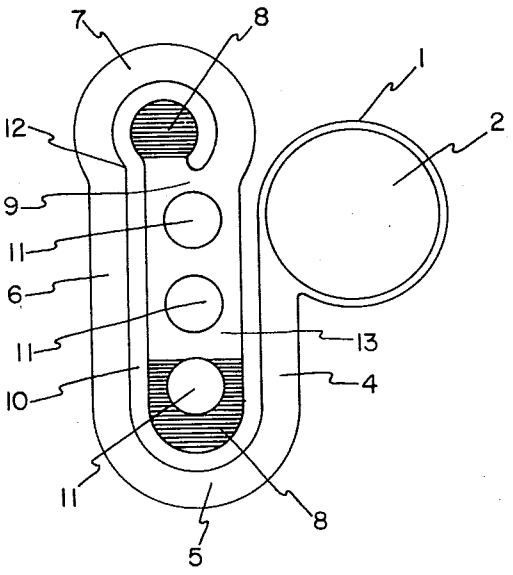
FIG. 5 is a front elevational view of another embodiment of the present invention omitting the hookmember and including a laterally extending circular portion.
Figure 4:
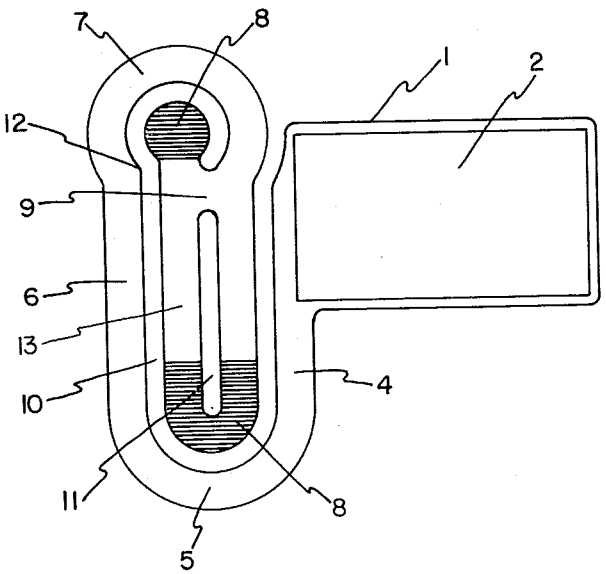
FIG. 4 is a front elevational view of another embodiment of the present invention omitting the hookmember and including a laterally extending rectangular portion.

A modified form of the paper clip of the present invention is shown at FIGS. 4 and 5 and is identical to the clip shown and described in FIGS. 1 to 3 with the exception that the extending hook portion is omitted.

In FIG. 4 the flag-like lateral extension 1 and area 2 for accommodating the adhesive backed informational label is rectangular in shape and the hole 11 is in the form of an elongated slot. The remaining structure is identical to that previously described.

At FIG. 5 the flag-like lateral extension 1 and the indicia receiving area 2 is circular in shape. This clip is otherwise identical in structure to those previously described.

Figure 7:
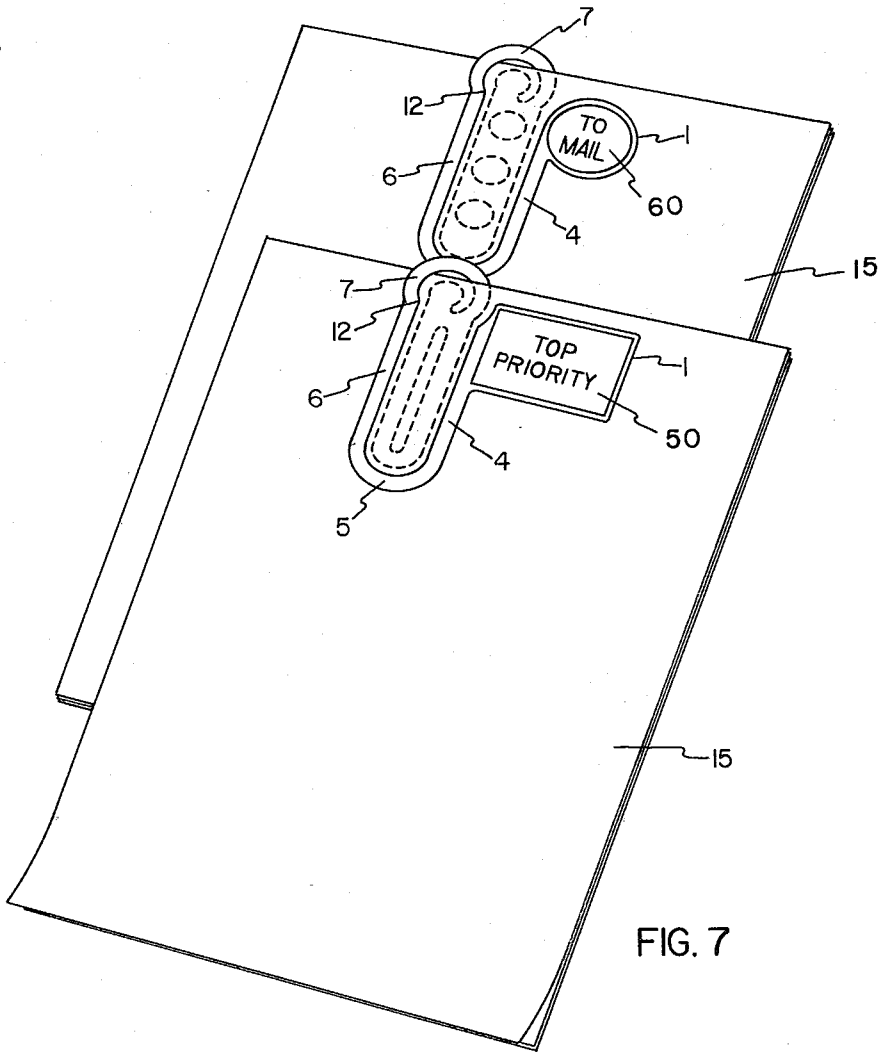
FIG. 7 is a perspective view showing the clip of FIGS. 4 and 5 fastening together several papers and displaying various instructional indicia.
Figure 6:
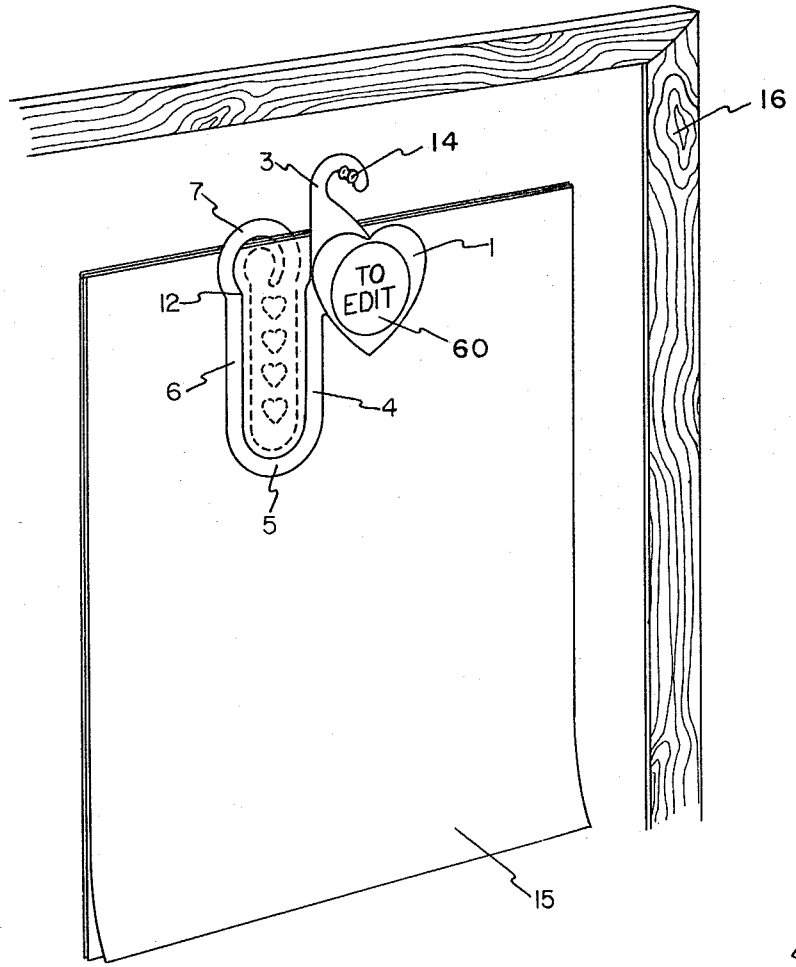
FIG. 6 is a perspective view showing the clip of FIG. 1 fastening together several papers and hanging from a peg on a bulletin board.
Figure 8:
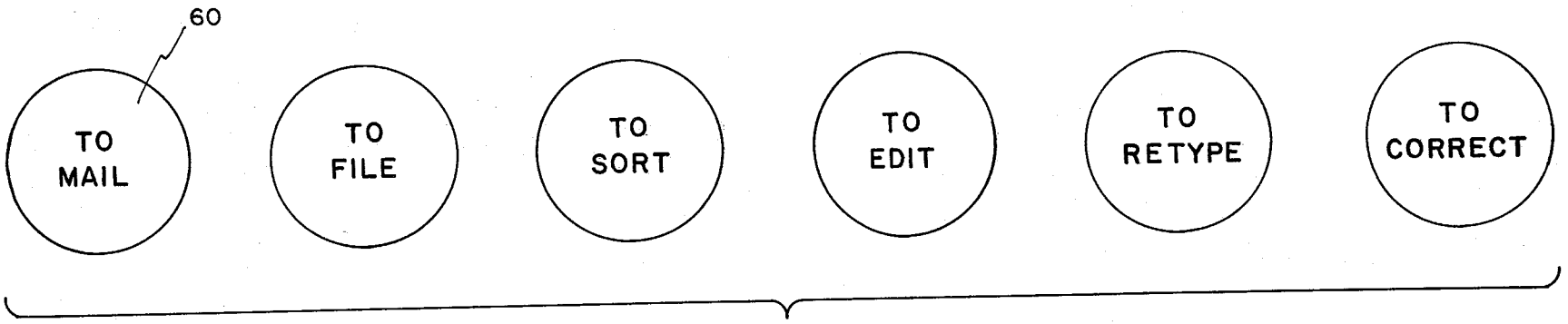
Figure 9:
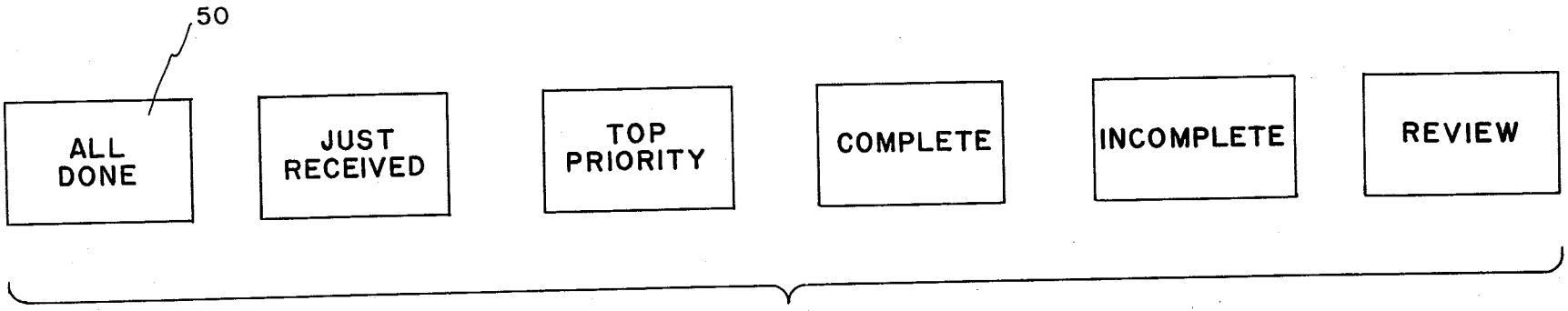
Figure 10:
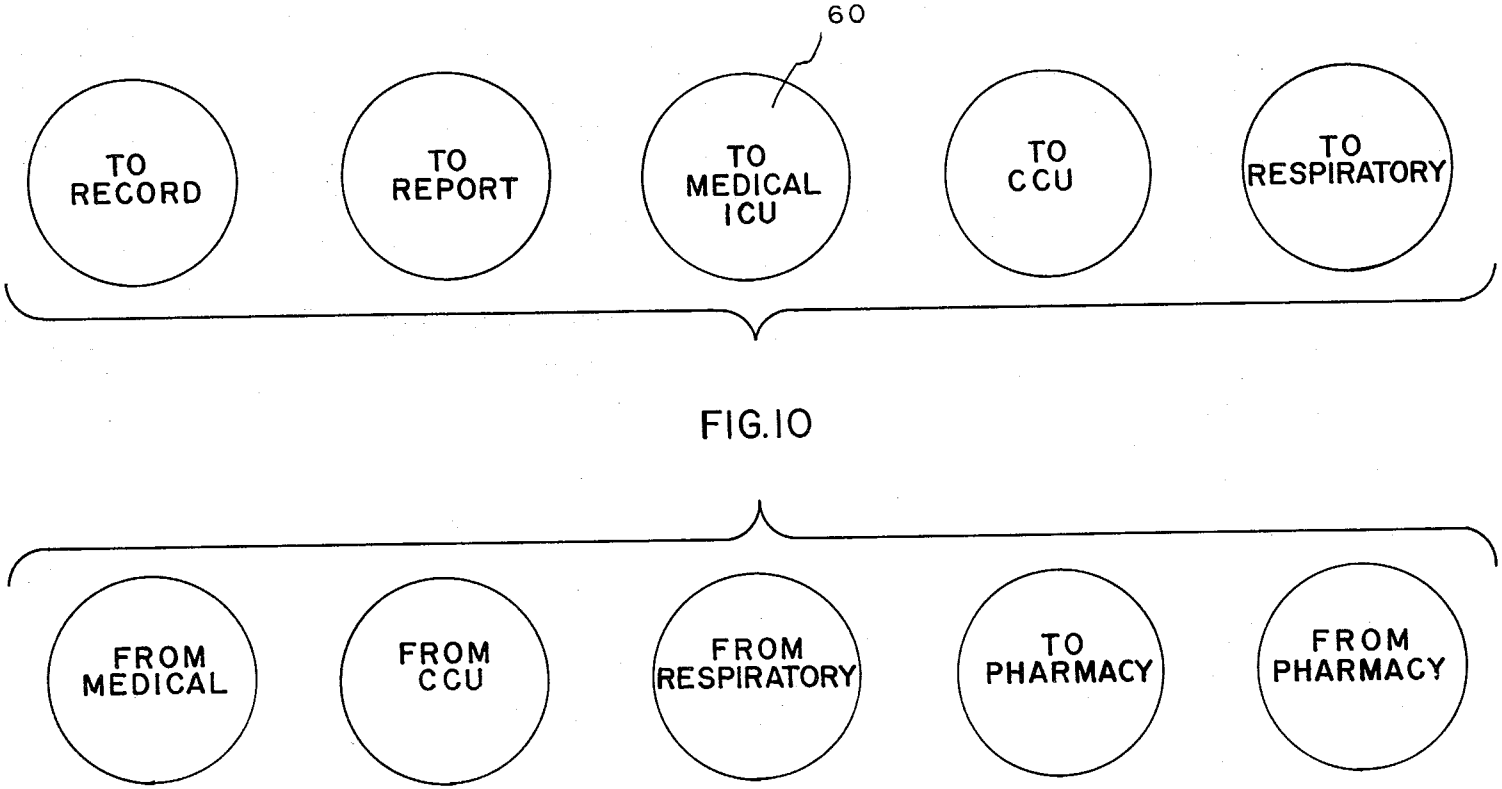

In FIGS. 6 and 7 show a perspective view of the two forms of clips displaying instructional indicia thereon and fastening together several papers 15.

The clip of the present invention including a hook-like member 3 is shown in FIG. 6 hanging from a tack 14, also shown is an informational label 60 affixed to the clip. The clips shown in FIG. 7 also display various informational indicia and being clipped to paperwork.

At FIGS. 8, 9, 10, 11, 11*a*, 11*b* are shown various shaped informational and instructional adhesive-backed labels that may be affixed to the laterally extending area of the paper clip.

The flag-like lateral extension which is shown in the embodiments to be at the right side in relation to the clip portion, may also be modified in such a manner that the said flag-like lateral extension may be structurally placed at the left side in relation to the clip portion; and so with the hook member.

Also various plastic materials such as polyethylene, polypropelene, etc. may be used in the various embodiments of the present invention as well as metals such as aluminium. Various colors for coding purposes may be incorporated into the material or externally applied as a dye or paint. Likewise, the material for the instructional labels may be paper, thin cardboard or thin plastic films or the like. The clips may also be made in any desired size depending upon the ultimate use and may be formed by conventional injection molding techniques or stamped from a single sheet of plastic.

Although illustrative embodiments of the invention have been described in detail with reference to the accompanying drawings, it is to be understood that the invention is not to be limited to those precise embodiments and that various changes in shapes or sizes or other modifications may be effected therein by one skilled in the art without departing from the scope or spirit of the invention.

I claim:

1. A unitary paper clip comprising:

a flat central member having at least one aperture therein;

raised ribs on upper and lower portions of said flat central member for engaging paper articles;

a hinge portion being connected to said flat central member in spaced relation thereto and having an arcuate slot therebetween;

said hinge portion having an upper curved flat portion, a first flat connecting arm, a lower flat arcuate member and a second flat connecting arm, said upper flat portion, first flat connecting arm, lower flat arcuate member and second flat connecting arm being integral;

a lateral extension member connected to said hinge portion by said second connecting arm and adapted to receive informational or instructional indicia thereon; and a hook member on said lateral extension for supporting said paper clip on any support member.

2. A unitary paper clip according to claim 1, wherein:

said hinge portion surrounding the central member and being complementary shaped.

3. A unitary paper clip according to claim 1, where:

said lateral extension being provided with gripping means.

4. A unitary paper clip according to claim 3, wherein:

said gripping means being in the form of a plurality of ribs.

5. A unitary paper clip according to claim 1, wherein:

said clip being provided in various colors to assist in correlating or segregating separate pieces of paperwork.

6. A unitary paper clip according to claim 1, wherein:

said indicia being in the form of labels color-coded to correspond to the color-coded clips.

7. A unitary paper clip according to claim 1, wherein:

said informational or instructional indicia being on adhesive-backed labels.

8. A unitary paper clip according to claim 1,wherein:

said hook member being provided at an upper portion of said lateral extension to facilitate hanging of the clip.

9. A unitary paper clip according to claim 1, wherein:

said central member being constructed of plastic material.

10. A unitary paper clip according to claim 1, wherein:

said hook member and said flat central member and said hinge being formed as a one-piece unitary construction.

11. A unitary paper clip according to claim 1, and:

said second connecting arm being provided with a protuberance to assist in gripping the clipped paperwork.

* * * * *